US005357414A

United States Patent [19]

Dane et al.

[11] Patent Number: 5,357,414

[45] Date of Patent: Oct. 18, 1994

[54] MODULAR CANTILEVERED ELECTRICAL LIGHT FIXTURE

[75] Inventors: Mark T. Dane, Milwaukee; Henry J. Griesmer, Hartford; Catherine Alexander, Milwaukee; Peter M. Zimmerman, Menomonee Falls; Pinkston S. Harper, Milwaukee; Steven A. Nickel, Sussex; Ronald A. Crawford, Cedarburg; Donald J. Zach, Greendale; Robert T. Jones, Sussex; James F. Morton, Milwaukee; Brian K. Johnston, Jackson, all of Wis.

[73] Assignee: Phoenix Products Company, Inc., Milwaukee, Wis.

[21] Appl. No.: 7,220

[22] Filed: Jan. 22, 1993

[51] Int. Cl.[5] ..... F21S 1/02

[52] U.S. Cl. ..... 362/431; 362/147; 362/432; 439/211

[58] Field of Search ..... 362/431, 432, 147, 226; 439/207, 211, 212, 214, 505, 507

[56] References Cited

U.S. PATENT DOCUMENTS

| | | | |
|---|---|---|---|
| 1,029,558 | 6/1912 | Palmer et al. | 248/342 |
| 1,786,515 | 12/1930 | Brownell | 362/430 |
| 3,519,811 | 7/1970 | Jacobs | 362/426 |
| 3,696,240 | 10/1972 | Potter | 240/73 BJ |
| 3,999,055 | 12/1976 | Wakahara et al. | 240/1.3 |
| 4,319,314 | 3/1982 | Morton | 362/432 |
| 4,338,653 | 7/1982 | Marrero | 362/223 |
| 4,378,584 | 3/1983 | Russello | 362/226 |
| 4,713,734 | 12/1987 | DeKay | 362/147 |
| 4,814,955 | 3/1989 | Price | 362/275 |
| 4,973,016 | 11/1990 | Hertenstein | 248/282 |
| 5,213,413 | 5/1993 | Weathers | 362/432 |
| 5,258,898 | 11/1993 | Thornton | 362/432 |

*Primary Examiner*—Ira S. Lazarus
*Assistant Examiner*—Sara Sachie Raab
*Attorney, Agent, or Firm*—Quarles & Brady

[57] ABSTRACT

A cantilevered electrical light fixture (10) has a power supply line (30) running through it from a mounted end (17) to an internal connection zone (36) at a cantilevered end (18). A cover (52) closes the internal connection zone (36) and mounts a plug-half (40) and a switch (42), which are electrically connected to the power supply line (30). A light head (16) mounted to the cantilevered end (18) by a post (76) with a non-circular portion (78) and a threaded shank (80) has lamp wiring (110) connected to a plug-half (120) which releasably mates with the plug-half (40) mounted to the arm (12). A U-shaped bracket (116) mounts a socket (114) to a shell (84) of the light head (16) to bias the lamp bulb (154) against the shell (84).

7 Claims, 3 Drawing Sheets

MODULAR CANTILEVERED ELECTRICAL LIGHT FIXTURE

FIELD OF THE INVENTION

This invention relates to a light fixture of the type having a tubular arm with a light supported near a cantilevered end of the arm, such as are used in industrial applications for lighting railroad or truck loading docks.

BACKGROUND OF THE INVENTION

Industrial lighting fixtures for lighting railroad or truck loading docks are well known and generally include a tubular arm, such as an arm made of one or more square tubular elements, with one end of the arm supported by being mounted to a wall or post. The other end of the arm is cantilevered from the wall or post and mounts an electrical light head which provides power to a lamp bulb for illuminating the desired area. The head can usually be pivoted about horizontal and vertical axes and the arm also pivoted about horizontal and vertical axes to allow directing the illumination to a wide variety of different areas.

Such fixtures are made for rough duty but occasionally become damaged, such as for example if a fork lift or truck runs into it. The part usually damaged is the light head, but the arm usually remains functionally intact. When such a mishap occurs, it is desirable to be able to replace the lighthead without having to replace the arm.

Also, there are a variety of different light heads which are available for these types of fixtures. For example, one type of light head uses an incandescent bulb, another type uses a metal halide bulb and still another type uses a high pressure sodium bulb. Moreover, for compactness in shipping it is usually desirable to detach the head from the arm and allow the customer to attach the head to the arm when the light fixture is installed. For these reasons, it is desirable to provide an electrical light fixture in which the electrical light head can be readily and easily detached from the arm and reinstalled.

Obstacles to providing a readily replaceable head are that it is desirable to run the electrical power supply cord inside of the tubular elements of the arm. This is for protection of the electrical power cord and also for aesthetics. However, fishing the cord through the arm cannot easily be done by an end user because the cord must be threaded into and out of the tubular elements through holes in the walls of the tube and proper precautions must be taken so as not to damage the insulation of the cord with the edges of the holes. The mechanical connection of the light head to the arm can also be a problem as the head must be movable relative to the arm with the proper degree of resistance so that it does not either bind excessively or flop around. Also, the head should be securable to the arm quickly and easily with readily available tools.

Another design feature of industrial light fixtures has been that the bulb socket is biased in a housing or shell of the light head so as to bias the bulb against the shell so that the bulb is held tightly to and centered in the shell. Complicated mechanisms involving multiple springs and separate relatively movable plates have been used to mount the socket to the shell to perform this function. Accordingly, a need exists for improved bracketry for mounting a socket to a shell in a light fixture of this type.

SUMMARY OF THE INVENTION

The invention provides a modular cantilevered electrical light fixture which overcomes the above problems. The fixture has a tubular support arm having a cantilevered end and a mounting end with an electric light head secured at the cantilevered end and a mounting bracket at the mounted end. Lamp wiring electrically connects the head to a first connector plug-half. An opening is formed in the arm adjacent to the cantilevered end to define a connecting zone within the arm. An electrical power supply line extends through the arm, has conductor ends in the connecting zone within the arm and exits the arm adjacent to the mounting end. A cover is secured to the arm over the opening and a second connector plug-half is secured to the arm adjacent the opening. The conductor ends are electrically connected to the second connector plug-half in the connecting zone within the arm, with the first and second connector plug-halves mating in releasable engagement with one another to provide an electrical connection between the electrical power supply line and the lamp wiring. Thereby, a readily releasable electrical connection is made between the arm and the head.

In a preferred aspect, an opening is formed in the cover and the second connector plug-half is mounted to the cover in the opening. A switch can also be provided in an opening in the cover. An assembly of a cover and plug-half or cover, plug-half and switch can be made, the wiring of the conductor ends to the plug-half and/or switch easily made outside the tube and the cover thereafter assembled to the tube for convenient and facile assembly.

In this respect, it is especially preferred to form the cover with an ear at one end which is offset from a facial plane of the cover by approximately a wall thickness of the tubular support arm. The ear is hooked over an edge of the opening behind a wall of the arm and the cover overlaps an exterior surface of the arm adjacent to the opening. Means at the opposite end of the cover secure the cover against the arm. Thereby, the cover is easily formed to create a strong, secure and easy connection between the cover and the arm.

In a preferred aspect, the electric light head securing means includes a post which is non-circular in cross section and extends through similarly shaped non-circular openings in the arm so that the post is restricted from rotating relative to the arm. The post pivotably mounts the head at one end and is secured at the opposite end to the arm with a threaded fastener which prevents the post from pulling out of the arm. With this construction, the head can be shipped with the post assembled to the head, but the head and arm separate. The head can then be assembled to the arm by the end-user by simply inserting the post through the tube of the arm and fastening it with the threaded fastener.

In another aspect, the head has a shell, a socket for receiving a lamp bulb and bracketry for mounting the socket to the shell so as to bias a bulb held in the socket against the shell. In this aspect, the bracket has a generally U-shaped cross section formed from a single piece of sheet material with a first lateral panel, a first longitudinal panel extending from an edge of the first lateral panel in a direction generally orthogonal to the first lateral panel, a second lateral panel extending from an edge of the first longitudinal panel in the same direction as the first lateral panel and spaced apart from the first lateral panel so as to define a space bounded on three sides by the first and second lateral panels and the first longitudinal panel. A socket is mounted to the second lateral panel with its axis extending in a direction generally orthogonal to the second lateral panel. The socket is oriented to receive a lamp bulb so that the bulb extends from the socket in a direction away from the first lateral panel. A pin generally aligned with the socket axis extends from the first lateral panel in a direction away from the second lateral panel and extends through the shell to a free end. A compression spring coaxial with the pin extends between the free end of the pin and the shell so as to bias the bracket toward the shell. In this manner, a simple structure is provided to mount the lamp socket to the shell with a connection that allows easy installation and changing of bulbs and a biased, secure, jiggle-free and centered connection between the lamp and the shell.

Other features and advantages of the invention will be apparent from the drawings and the detailed description.

DETAILED DESCRIPTION OF THE PREFERRED EMBODIMENTS

Figure 1:
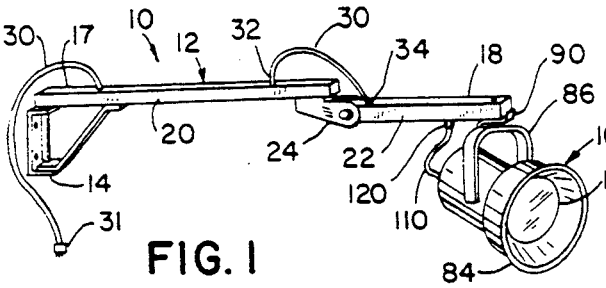
FIG. 1 is a perspective view of a modular cantilevered electrical light fixture of the invention.

Referring to FIG. 1, a modular cantilevered electrical light fixture 10 of the present invention includes an arm 12 with a mounting bracket 14 secured at mounted end 17 and a light head 16 secured at cantilevered end 18. Mounting bracket 14 is typically secured to a wall or post with the arm 12 in the orientation shown in FIG. 1 so that arm 12 is pivotable relative to bracket 14 about a vertical axis.

Figure 2:
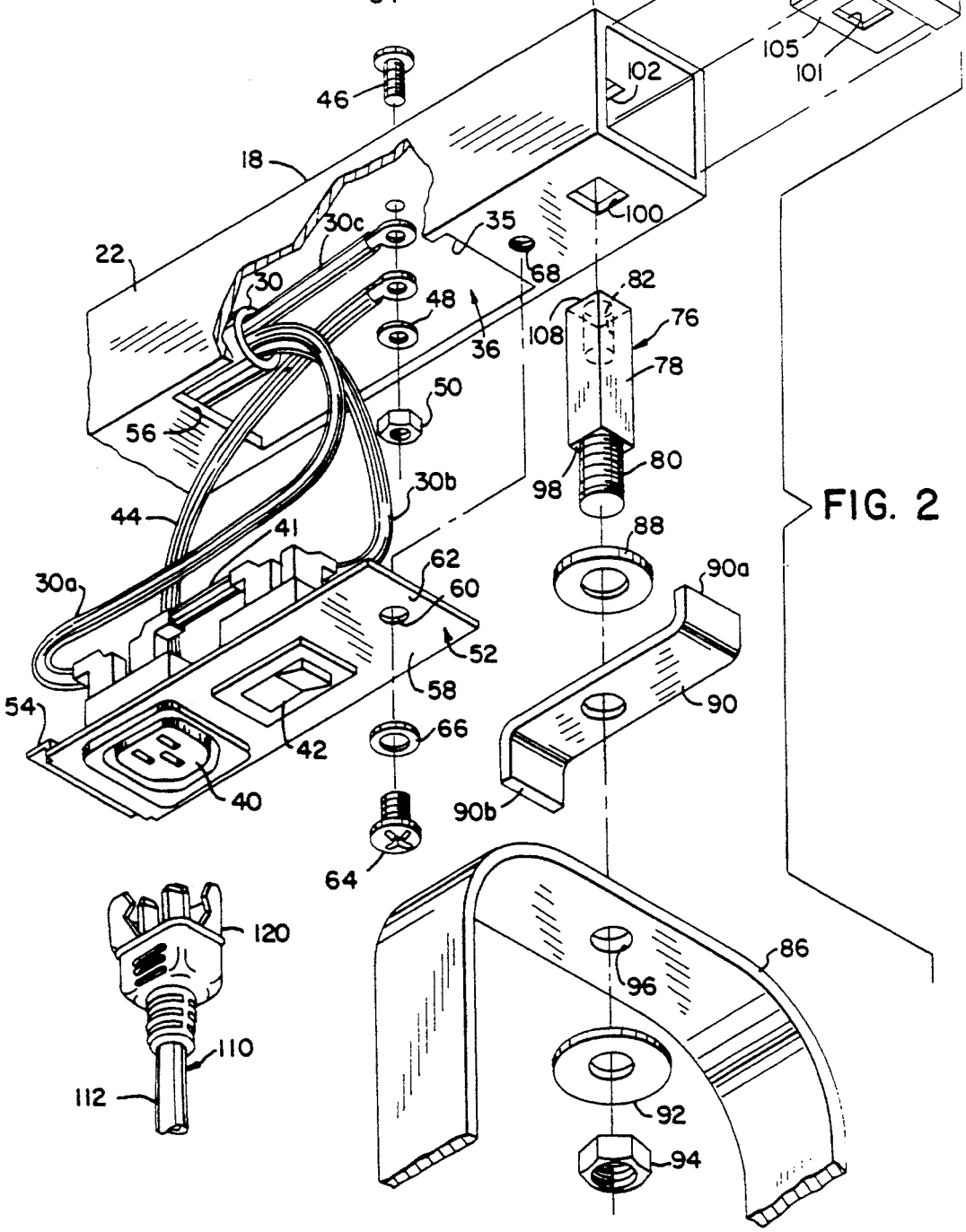
FIG. 2 is an exploded perspective view of the cantilevered end portion of the fixture of FIG. 1 with portions broken away.

In the fixture 10 shown, the arm 12 includes two end-to-end connected tubes 20 and 22, preferably made of steel. The tubes 20 and 22 are hollow and have a generally square cross section as shown in FIG. 2. Intermediate the ends 17 and 18 of the arm 12, the tubes 20 and 22 are connected by a tube-to-tube bi-axial pivot connector bracket 24. In general, the mounting bracket 14 allows pivoting of the arm 12 relative to the wall or post to which the arm 12 is mounted about a vertical axis, the bracket 24 permits pivoting tubes 20 and 22 relative to one another about both vertical and horizontal axes, and the head 16 is pivotable relative to tube 22 about vertical and horizontal axes, as described further below.

An electrical power supply line 30 exits arm 12 adjacent to mounted end 17 through a hole in the top side of tube 20 and extends therefrom as shown in FIG. 1. The extending end may be provided with a plug 31 or not, in which case it may simply have loose conductor ends for hard-wiring into an electrical system, for example the electrical system of the loading dock to which the fixture 10 is mounted. From the mounted end 17, line 30 extends through the tube 20 to near the opposite end of tube 20 adjacent to bracket 24 where it exits tube 20 at 32, extends past bracket 24 and enters tube 22 at 34 through a hole in the top side of tube 22.

Figure 3:
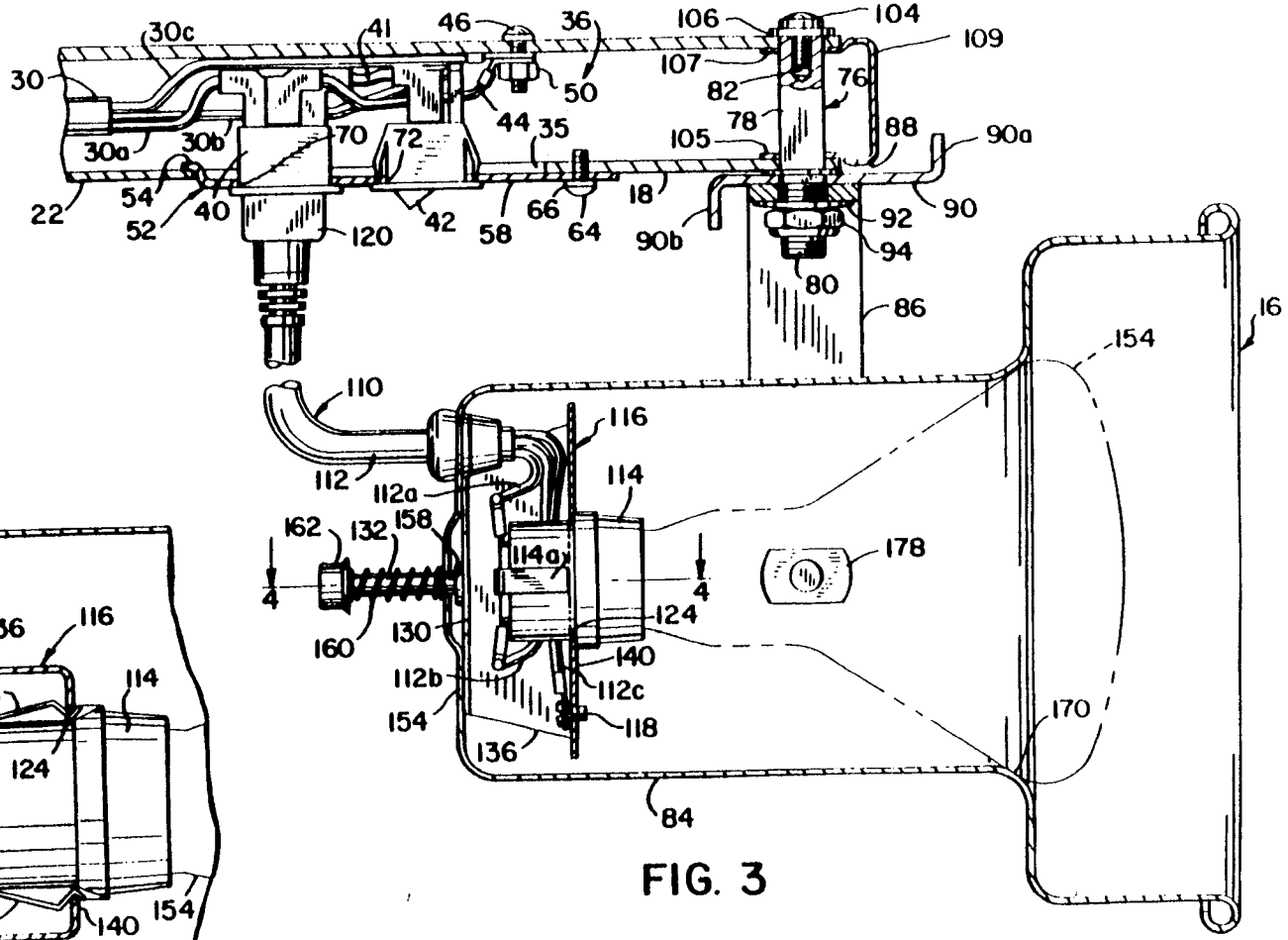
FIG. 3 is a sectional view of the cantilevered end portion shown in FIG. 2 and showing a lamp bulb in phantom.
Figure 4:
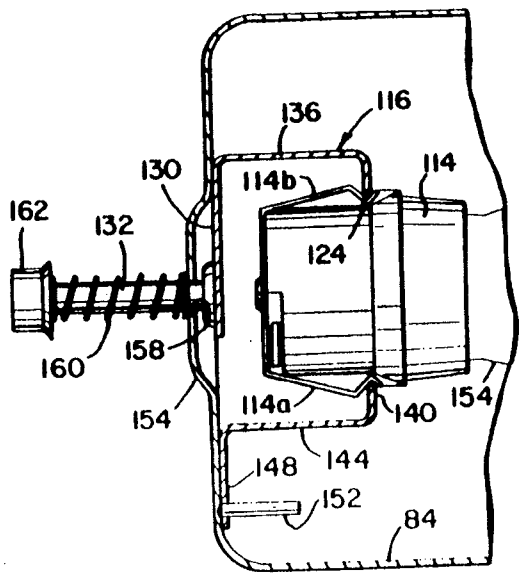
FIG. 4 is a detail sectional view of a rear portion of the lamp head shown in FIG. 3.

Referring now to FIGS. 2 and 3, line 30 extends through tube 22 up to cantilevered end 18 where an opening 35 is formed in the bottom side of tube 22. Inside tube 22 adjacent to opening 35 a connecting zone 36 is defined in which electrical connections are made between conductor ends 30*a*, 30*b* and 30*c* of the conductors of the line 30. Conductor end 30*a* is electrically connected to one power terminal of a female plug-half 40 and the other power terminal of the plug-half 40 is electrically connected by conductor 41 to a pole of a switch 42. The other pole of the switch 42 is connected to conductor end 30*b*. Conductor end 30*c*, which is the ground conductor of line 30, is electrically connected to the ground terminal of plug-half 40 by wire 44 and both the conductor end 30*c* and the wire 44 are connected electrically to the tube 22 by screw 46, washer 48 and nut 50.

The plug-half 40 and the switch 42 are both mounted in appropriate respective openings 70 and 72 (FIG. 3) in the cover 52. One end of cover 52 is laterally offset from the facial plane portion 58 of the cover 52 by a distance approximately equal to the wall thickness of tube 22 to form an ear 54. The ear 54 is hooked over an edge 56 of opening 35 behind the lower wall of tube 22 and the facial plane portion 58 of cover 52 overlaps the exterior surface of the lower wall of tube 22 adjacent to the opening 35 along the side edges of the opening and at the opposite end of the opening. A hole 60 is provided at end 62 of cover 52 and a screw 64 extends through hole 60 (with washer 66 between screw 64 and cover 52) and is threaded into hole 68 in the lower wall of tube 22 to secure the cover 52 to the tube 22.

A post 76 preferably made of rectangular or square steel bar stock has a non-circular portion 78, which in the preferred embodiment has a square cross section, and an integral threaded shank 80 extending from one end of the non-circular portion 78. At the other end of non-circular portion 78 is a threaded blind bore 82.

Head 16 includes a shell 84 and a yoke 86 secured to each side of the shell in the manner described below so that the shell 84 is pivotable about a horizontal axis relative to the yoke as viewed in FIG. 1. The yoke 86 is secured to the lower end of post 76 by a washer 88, a rotation limiter 90, a second washer 92 and a nut 94, which is preferably the type of well-known locknut having a plastic insert to resist turning of the nut on the shank 80. Threaded shank 80 is inserted through the elements 88, 90, a hole 96 in yoke 86 and washer 92, and nut 94 is threaded onto the end of shank 80 to compress the elements 88, 90, 86 and 92 between nut 94 and shoulder 98 defined by the end of non-circular portion 78 at the junction between portion 78 and shank 80.

Non-circular portion 78 is of a length approximately equal to the exterior height of tube 22 so that portion 78 extends from hole 100 in the lower wall of tube 22 up to and through hole 102 and the upper wall of tube 22. Preferably, portion 78 also extends through holes 101 and 103 formed in legs 105 and 107 of end cap 109 which is inserted into the cantilevered end 18 of tube 22 so as to close off the end. The holes 100–103 are of the same shape as non-circular portion 78 but slightly larger so that non-circular portion 78 can be easily slid therein but not so large as to permit any significant relative rotation of the post 76 relative to the arm 22. The assembly of the post 76 and yoke 86 is secured to arm 22 by screw 104 extending through washer 106 and being threaded into bore 82 in the top of post 76. Preferably, non-circular portion 78 is slightly less than the exterior height of tube 22 so that screw 104 slightly compresses tube 22 when it is tightened, although the dimensions may be chosen such that washer 106 also abuts top face 108 of post 76 when screw 104 is tightened.

In well known manner, rotation limiter 90 has oppositely directed orthogonal ends 90*a* and 90*b* which prevent 360° rotation of the yoke 86 relative to the tube 22. Upon approaching the limit of rotation in either angular direction about the vertical axis of post 76, end 90*a* contacts a side of tube 22 and end 90*b* contacts a side of yoke 86 to positively stop rotation of the yoke 86 relative to the tube 22 so as to prevent damage to lamp wiring 110.

Lamp wiring 110 includes a cord 112 having conductor ends 112*a*, 112*b* and 112*c* within shell 84. Conductor ends 112*a* and 112*b* are electrically hard-wired, preferably by mating male and female double-barrel connectors, to power terminals of socket 114 which is supported within shell 84 by bracket 116 as more fully described below. Conductor end 112*c* is electrically hard-wired by screw 118 to bracket 116 to provide a ground connection. At the opposite end of cord 112, cord 112 is electrically hardwired to male plug-half 120 which is configured to mate with female plug-half 40. It is noted that the plug halves 120 and 40 may be of any mating configuration, such as the international style shown, the style conventional in the United States, any suitable appliance type plug, or any other suitable configuration. It is only essential that the plug halves 40 and 120 be such as to make electrical connections between the conductors of electric power supply line 30 and the conductors of tamp wiring 110.

Socket 114 is of a well known push in type having spring legs 114*a* and 114*b* which engage in hole 124 of bracket 116 to hold socket 114 in the hole 124. Plug-half 40 and switch 42 are also preferably of a push in type for ease of assembly of the plug-half 40 and switch 42 to the cover 52. Referring particularly to FIGS. 3–6, the bracket 116 is formed from a single piece of sheet metal, preferably galvanized steel. Referring particularly to FIG. 6, the bracket 116 has a first lateral panel 130 with a pin 132 welded thereto which extends rearwardly and is substantially coaxial with socket axis 134 defined by socket 114. First longitudinal panel 136 extends forwardly from edge 138 of panel 130 and at its forward edge second lateral panel 140 extends generally orthogonally from panel 136 in the same direction as does panel 130. Hole 124 for mounting socket 114 is formed in panel 140 coaxial with socket axis 134. At the edge 142 of panel 140 opposite from panel 136 a second longitudinal panel 144 extends in the same direction (rearwardly) from the panel 140 as does the panel 136. Third lateral panel 148 extends from edge 146 of panel 144 in the same direction that panel 130 extends from panel 136 and in generally the same plane as panel 130.

Third lateral panel 148 has a bearing hole 150 formed therein which slides along a pin 152 (FIGS. 4 and 5) which is pressed in, welded or otherwise secured to the rear wall 154 of the shell 84 and extends forwardly therefrom. The engagement of pin 152 in hole 150 prevents rotation of the bracket 116 and socket 114, which is particularly helpful when a bulb 154 is screwed into or out of the socket 114.

Pin 132 extends rearwardly from panel 130 and through hole 158 in rear wall 154 of shell 84. Compression spring 160 surrounds pin 132 and is generally coaxial therewith. One end of compression spring 160 bears against rear wall 154 and the other end of the spring 160 bears against a push nut 162 which is secured to the free end of pin 132. Therefore, spring 160 biases bracket 116 rearwardly toward rear wall 154.

The lamp 154 shown is of the incandescent type. Different lengths of incandescent lamps are available but in general they're all cone shaped and of a diameter to seat against shoulder 170 of shell 84. A relatively long lamp 154 is shown in FIG. 3, so that pin 132 is shown at, or nearly at, its full extension out rear of wall 154. However, even with a long lamp 154 as shown in FIG. 3, spring 160 biases bracket 116 rearwardly to pull bulb 154 rearwardly against seat 170 so as to center bulb 154 in the shell 84 and provide a jiggle free connection between the bulb 154 and the shell 84. In addition, when bulb 154 is being screwed into socket 114, nut 162 can be pushed forwardly so as to facilitate the threading of bulb 154 into the socket 114.

Moreover, if a shorter bulb 154 were used, pin 132 would extend less far out the rear wall 154 and a space would exist between panel 130 and rear wall 154 determined by the length of the particular bulb used.

Figure 5:
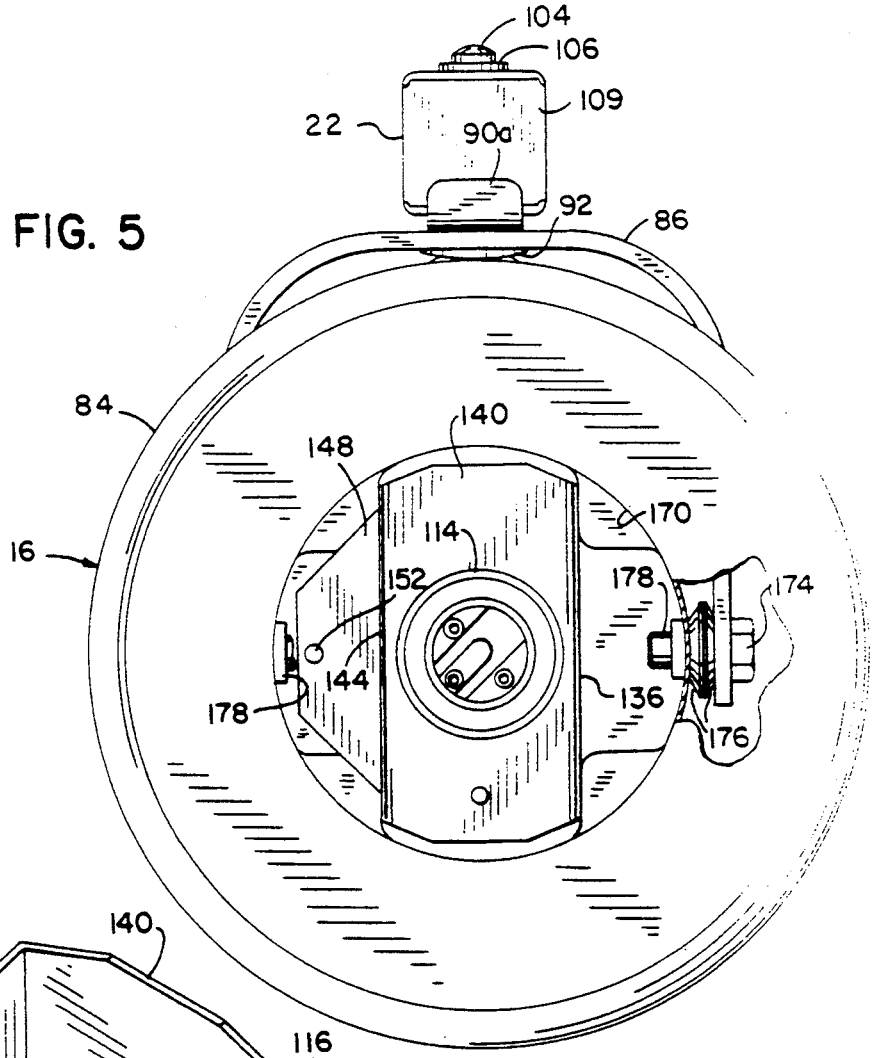
FIG. 5 is a front plan view of the fixture shown in FIG. 3.
Figure 6:
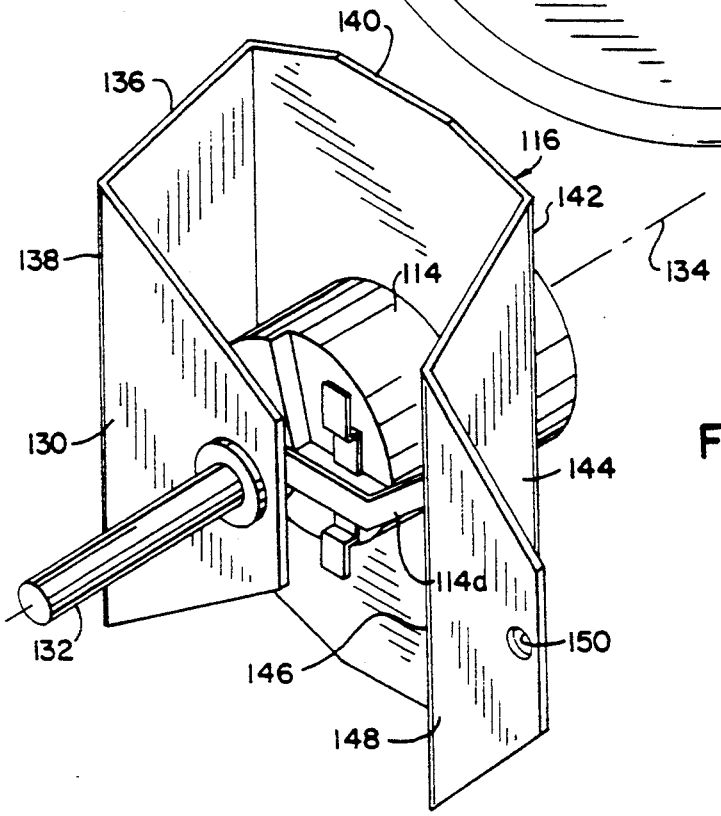
FIG. 6 is a perspective view of bracketry for mounting the lamp socket to the shell of the light head.

Shell 84 is secured to yoke 86 by a bolt 174 at each side (one shown in FIG. 5). On each side of the yoke 86, a bolt 174 is inserted through a hole near the lower end of the leg on the particular side of the yoke 86 and through a pair of facing belleville springs 176. A nut 178 is welded to the interior of shell 84 in alignment with each bolt 174 and the corresponding bolt 174 extends through an aligned hole in the shell 84 to be threaded into nut 178.

It should be noted that the bracket 116 disclosed is most useful with incandescent bulbs. However, in practicing other aspects of the invention, other types of bulbs such as metal halide or high pressure sodium may be used.

It should also be noted that in the embodiment disclosed, the arm 12 includes two separate tubes 20 and 22. However, the invention may be practiced with an arm having a single tube, or more than two tubes.

Preferred embodiments of the invention have been described in considerable detail. Numerous modifications and variations will be apparent to those of ordinary skill in the art. Therefore, the invention should not be limited to the embodiments disclosed, but should be defined by the claims, which follow.

We claim:

1. A modular cantilevered electrical light fixture, comprising:

a tubular support arm having a mounting end for mounting to a support structure and a cantilevered end for mounting an electric light head;

an electric light head;

means securing said electric light head to said arm at said cantilevered end;

lamp wiring electrically connected to said head at a head end of said wiring and having a first connector plug-half at a plug end of said wiring which is opposite from said head end;

a mounting bracket secured to said arm at said mounting end for securing said arm to a support structure;

an opening formed in said arm adjacent said cantilevered end, said opening defining thereunder a connecting zone within said arm;

an electrical power supply line extending through said arm, said supply line having conductor ends in said connecting zone within the arm and exiting said arm adjacent to said mounting end;

a cover secured to the arm over the opening;

a second connector plug-half secured to said arm adjacent said opening, said conductor ends being electrically connected to said second connector plug-half in the connecting zone within the arm, said first and second connector plug-halves mating in releasable engagement with one another to provide an electrical connection between said electrical power supply line and said lamp wiring; and a switch secured to said arm adjacent said opening, said switch being wired to control power from said electrical power supply line to said second connector plug-half.

2. A modular electrical light fixture as in claim 1, wherein said switch and second connector plug-half are secured in openings in said cover.

3. A modular cantilevered electrical light fixture, comprising:

a tubular support arm having a mounting end and a cantilevered end;

an electric light head;

means securing said electric light head to said arm at said cantilevered end;

lamp wiring electrically connected to said head at a head end of said wiring and having a first connector plug-half at a plug end of said wiring which is opposite from said head end;

a mounting bracket secured to said arm at said mounting end;

an opening formed in said arm adjacent said cantilevered end, said opening defining thereunder a connecting zone within said arm;

an electrical power supply line extending through said arm, said supply line having conductor ends in said connecting zone within the arm and exiting said arm adjacent to said mounting end;

a cover secured to the arm over the opening; and a second connector plug-half secured to said arm adjacent said opening, said conductor ends being electrically connected to said second connector plug-half in the connecting zone within the arm, said first and second connector pug-halves mating in releasable engagement with one another to provide an electrical connection between said electrical power supply line and said lamp wiring;

wherein said cover has an ear at an ear end which is offset from a facial plane of said cover by approximately a wall thickness of said tubular support arm and is hooked over an edge of said opening behind a wall of said arm, said cover overlaps an exterior surface of said arm adjacent to said opening and further comprising means at an end of said cover which is opposite from said ear end securing said cover against said arm.

4. A modular cantilevered electrical light fixture, comprising:

a tubular support arm having a mounting end and a cantilevered end;

an electric light head;

means securing said electric light head to said arm at said cantilevered end;

lamp wiring electrically connected to said head at a head end of said wiring and having a first connector plug-half at a plug end of said wiring which is opposite from said head end;

a mounting bracket secured to said arm at said mounting end;

an opening formed in said arm adjacent said cantilevered end, said opening defining thereunder a connecting zone within said arm;

an electrical power supply line extending through said arm, said supply line having conductor ends in said connecting zone within the arm and exiting said arm adjacent to said mounting end;

a cover secured to the arm over the opening; and a second connector plug-half secured to said arm adjacent said opening, said connector ends being electrically connected to said second connector plug-half in the connecting zone within the arm, said first and second connector plug-halves mating in releasable engagement with one another to provide an electrical connection between said electrical power supply line and said lamp wiring;

wherein said electric light head securing means includes a post which is non-circular in cross section and extends through similarly shaped non-circular openings in said arm so that said post is restricted from rotating relative to said arm, said post pivotably mounting said head at one end and being secured at said opposite end to said arm with a threaded fastener which prevents said post from pulling out of said arm.

5. A modular cantilevered electrical light fixture as in claim 3 or 4, wherein an opening is formed in said cover and said second connector plug-half is mounted to said cover in said opening.

6. A modular cantilevered electrical light fixture as in claim 3 or 4, further comprising a switch secured to said arm adjacent said opening.

7. A modular electrical light fixture as in claim 6, wherein said switch and second connector plug-half are secured in openings in said cover.

* * * * *